US008141626B2

(12) United States Patent
Freyer

(10) Patent No.: US 8,141,626 B2
(45) Date of Patent: Mar. 27, 2012

(54) PACKER-ANCHORING DEVICE

(75) Inventor: Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/978,113

(22) Filed: Dec. 23, 2010

(65) Prior Publication Data

US 2011/0088892 A1 Apr. 21, 2011

Related U.S. Application Data

(62) Division of application No. 11/913,100, filed as application No. PCT/NO2006/000170 on May 8, 2006, now Pat. No. 7,874,354.

(30) Foreign Application Priority Data

May 9, 2005 (NO) ..... 20052260

(51) Int. Cl.
*E21B 23/01* (2006.01)

(52) U.S. Cl. ..... 166/134; 166/179

(58) Field of Classification Search ..... 166/134, 166/179, 206, 212
See application file for complete search history.

(56) References Cited

U.S. PATENT DOCUMENTS

| | | | | |
|---|---|---|---|---|
| 2,726,722 | A | 12/1955 | Baker | |
| 2,797,759 | A | 7/1957 | Long et al. | |
| 2,885,009 | A | 5/1959 | Baker | |
| 2,945,541 | A | 7/1960 | Maly et al. | |
| 3,343,607 | A | 9/1967 | Current | |
| 3,358,766 | A | 12/1967 | Current | |
| 3,381,969 | A | 5/1968 | Crow et al. | |
| 3,385,679 | A | 5/1968 | Current | |
| 3,520,361 | A * | 7/1970 | Lewis | 166/134 |
| 4,349,204 | A | 9/1982 | Malone | |
| 4,765,404 | A | 8/1988 | Bailey et al. | |
| 4,892,144 | A | 1/1990 | Coone | |
| 5,027,894 | A | 7/1991 | Coone et al. | |
| 6,318,482 | B1 | 11/2001 | Fidtje | |
| 6,581,682 | B1 | 6/2003 | Parent et al. | |
| 2004/0134659 | A1 | 7/2004 | Hoffman et al. | |

FOREIGN PATENT DOCUMENTS

| | | | |
|---|---|---|---|
| WO | 2006121340 | A1 | 11/2006 |
| WO | 2008091345 | A1 | 7/2008 |

OTHER PUBLICATIONS

Canadian Office Action issued Aug. 13, 2009, for Canadian Patent Application Serial No. 2,606,771, 2 pages.

Chinese Office Action issued Jun. 13, 2010, for Chinese Patent Application Serial No. 200680016020.1, 5 pages.

Office Action issued Apr. 29, 2010, for U.S. Appl. No. 11/913,100, 15 pages.

* cited by examiner

*Primary Examiner* — Hoang Dang
(74) *Attorney, Agent, or Firm* — Marlin R. Smith

(57) ABSTRACT

A packer-anchoring device between an annular packer and a body, wherein the annular packer is provided, at least at one of its end portions, with an expandable end ring.

7 Claims, 3 Drawing Sheets

PACKER-ANCHORING DEVICE

CROSS-REFERENCE TO RELATED APPLICATION

This application is a division of prior application Ser. No. 11/913,100 filed on Sep. 12, 2008, which is a national stage filing under 35 USC 371 of prior international application no. PCT/NO06/000170, filed 8 May 2006, which claims priority to a prior Norwegian application serial no. 20052260, filed 9 May 2005. The entire disclosures of these prior applications are incorporated herein by this reference.

This invention relates to a packer-anchoring. More particularly it concerns the anchoring of an expandable annular packer to a normally tubular object by means of a reinforcement and an expandable end ring, in particular for use in a borehole in connection with the recovery of petroleum It is known for expandable annular packers to be arranged round a production pipe or an injection pipe before the pipe is run into a borehole. The aim is typically to isolate part of the borehole from the rest of the borehole. The annular packer may be swellable and designed to swell in contact with a fluid present in the borehole, or it may be expanded by means of diffusion.

It has turned out that known methods of chemical bonding between an annular packer and a pipe, such as gluing or vulcanisation, do not exhibit sufficient strength when the packer is subjected to a relatively high temperature of use, for example during the recovery of petroleum.

The invention has as its object to remedy or reduce at least one of the drawbacks of the prior art.

The object is realized according to the invention through the features specified in the description below and in the following Claims.

An annular packer in accordance with the invention is provided, at least at one of its end portions, with an expandable end ring which encircles a body, to which the annular packer is connected. Between its inner mantle and its outer mantle the annular packer is preferably provided with a reinforcement encircling the body.

Typically, the expandable end ring is radially slit, alternately from its inside and from its outside. In a cross-sectional view, the end ring has an angular shape, one leg of the angle forming a disc-shaped part projecting inwards, and a second leg of the angle forming a sleeve part, the sleeve part extending in an encircling manner over the end portion of the annular packer.

The expandable end ring is preferably made of a synthetic material, for example PTFE. The reinforcement which is located in the packer material, is preferably of a helical shape and arranged to clamp the annular packer material to the body. The reinforcement may, with advantage, be metallic.

The use of an anchoring according to the invention essentially overcomes the drawbacks connected with the prior art anchoring of swellable packers. The invention reduces, to a considerable degree, the risk currently present of separation of the annular packer from the body.

In what follows there is described a non-limiting example of a preferred embodiment which is visualized in the accompanying drawings, in which.

Figure 1:
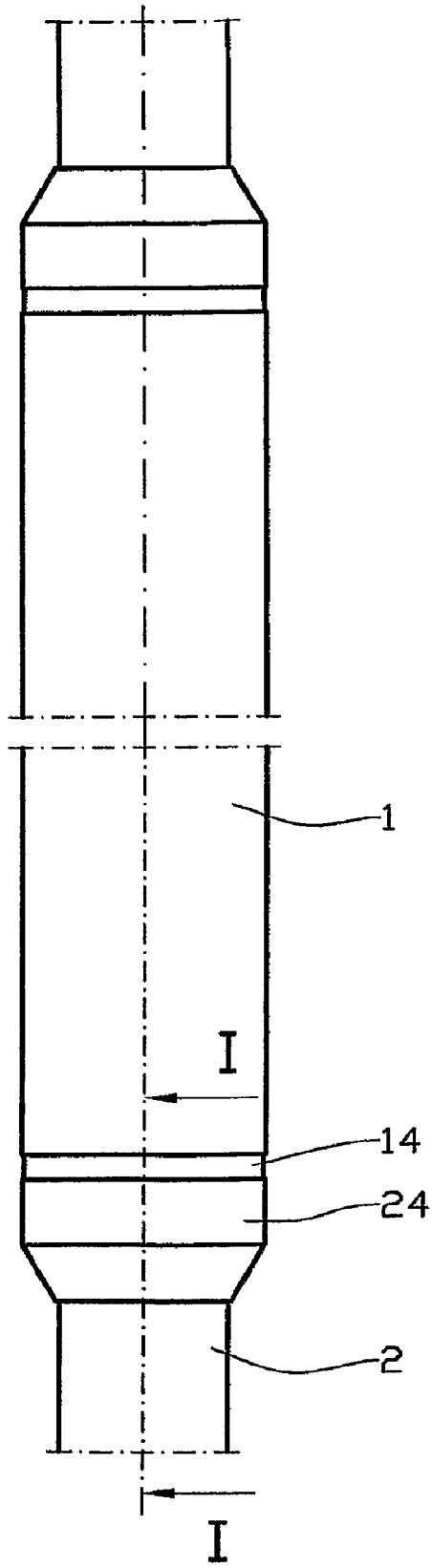
FIG. 1 shows a relatively elongate swellable annular plug encircling a pipe.
Figure 2:
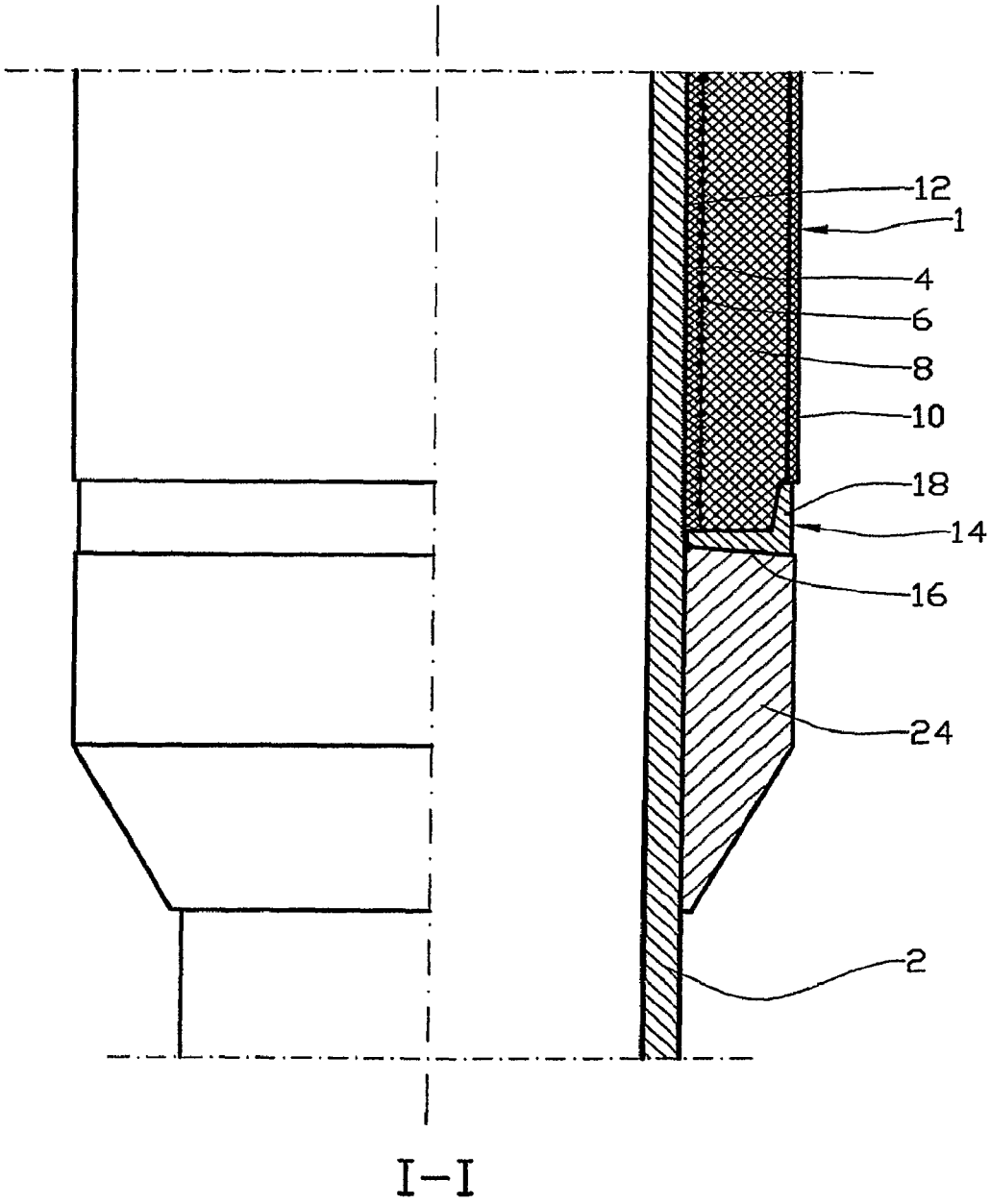
FIG. 2 shows, on a larger scale, a section of FIG. 1.

In the drawings the reference numeral 1 identifies a relatively elongate swellable annular packer encircling a body 2 in the form of a pipe.

The annular packer 1 is built up from a number of layers placed on top of each other, an inner layer 4 encircling the pipe 2 and being clamped against the pipe 2 by a helical reinforcement 6. The reinforcement 6 is typically formed by stainless wire.

Encircling the inner layer 4 and the reinforcement 6, there is arranged an intermediate layer 8, whereas an outer layer 10 encircles the intermediate layer 8. It is advantageous for the layers 4, 8 and 10 to be bonded together, for example by means of vulcanisation.

The layers 4, 8, 10 may be provided with fibres and have equal or different swelling. The pipe 2 may, with advantage, be provided with a thread-like groove 12 in the area of the annular packer 1.

At its end portions the annular packer 1 is provided with an expandable end ring 14 encircling the pipe 2 and having a cross-section in the shape of an angle. A first leg of the angle forms a disc 16 projecting radially inwards, whereas a second leg of the angle forms a sleeve 18 extending axially.

Figure 3:
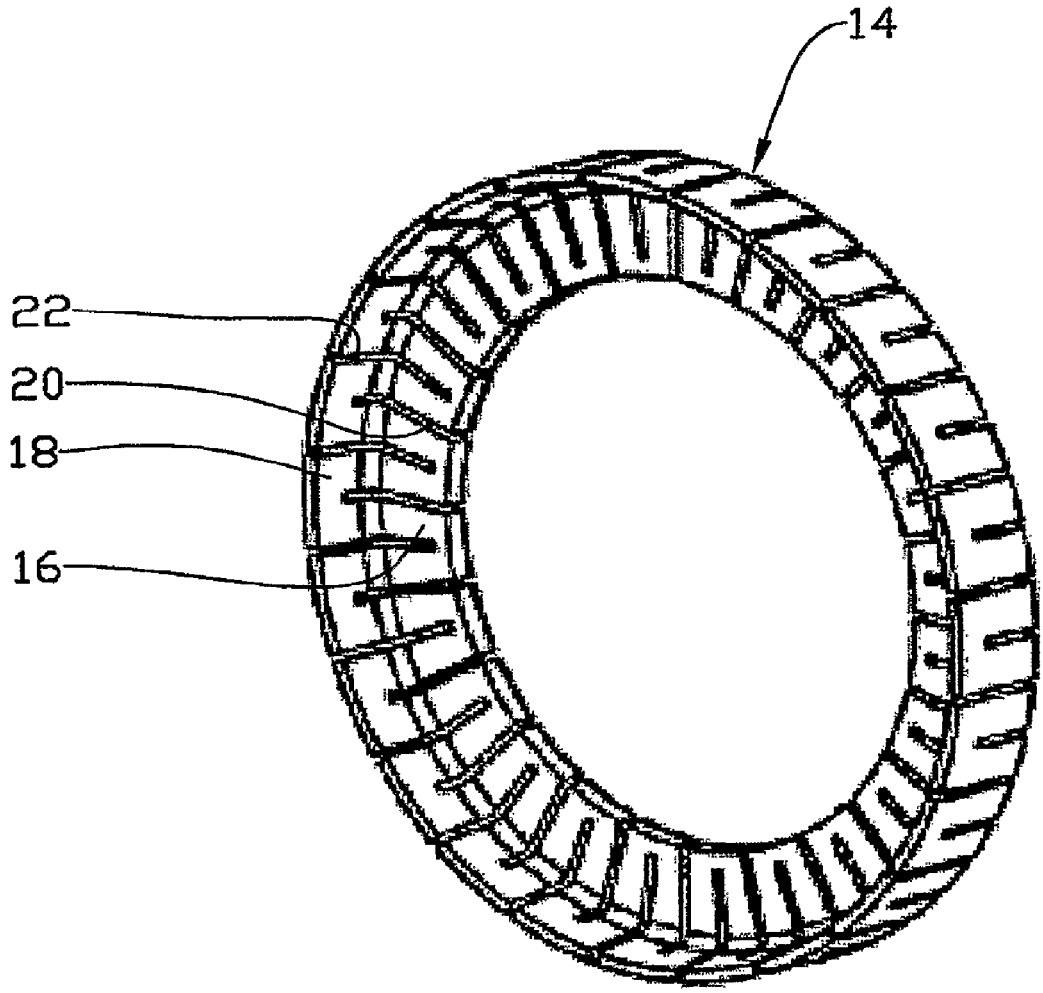
FIG. 3 shows in perspective an expandable end ring.

The end ring 14 is slit, see FIG. 3, by a number of first radial slits 20 extending from the inside, and a number of alternate second radial slits 22 extending from the outside. The end ring 14 is thereby sufficiently weakened to expand radially.

The disc 16 bears on the end portion of the annular packer 1, whereas the sleeve 18 encloses and extends somewhat over the same end portion.

The end ring 14 is supported by a supporting sleeve 24 which is connected to and encircles the pipe 2.

When the annular packer 1 has been run into a borehole, not shown, where it is swellingly influenced by a fluid, the volume of the annular packer 1 and thereby the external diameter are increased. During the expansion the reinforcement 6 is tensioned as there is an attempt to increase the diameter at which the reinforcement 6 is located. This helps the annular packer 1 to be further clamped to the pipe 2.

The diameter of the expandable end ring 14 increases with the external diameter of the annular packer 1, thereby preventing packer material from the annular packer 1 from entering an annular space, not shown, which encircles the supporting sleeve 24.

The invention claimed is:

1. An anchoring device for an annular packer having a first end region and a second end region and being disposed on a tubular body, the anchoring device comprising:

a sleeve connected to and encircling an exterior area of said tubular body; and an expandable ring, a portion of which is arranged between the first end region of said packer and an abutment area of said sleeve, wherein the expandable ring includes a plurality of first radial slits extending from an inside diameter of the expandable ring and a plurality of second radial slits extending from an outside diameter of the expandable ring.

2. The anchoring device of claim 1, wherein the ring is expandable from a first radial position substantially corresponding to an un-expanded state of said packer, to a second radial position substantially corresponding to an expanded state of said packer.

3. The anchoring device of claim 2, wherein said radial expansion of said ring is effected by an expansion of said packer.

4. The anchoring device of claim 1, wherein said portion of said ring is supported by said abutment area of said sleeve and arranged to slide in a radial direction with respect to the tubular body when said packer expands.

5. The anchoring device of claim 1, wherein the packer comprises a helical reinforcement element, the reinforcement element encircling the circumference of said packer and being disposed between a packer inner layer and a packer intermediate layer.

6. The anchoring device of claim 1, wherein the tubular body comprises threads in its external surface in the region of the annular packer.

7. An anchoring device for an annular packer having a first end region and a second end region and being disposed on a tubular body, the anchoring device comprising:

a sleeve connected to and encircling an exterior area of said tubular body; and an expandable ring, a portion of which is arranged between the first end region of said packer and an abutment area of said sleeve, wherein the packer comprises a material which expands by swelling when exposed to fluids, or by diffusion.

* * * * *